US009130354B2

(12) United States Patent
Ehrhardt et al.

(10) Patent No.: US 9,130,354 B2
(45) Date of Patent: Sep. 8, 2015

(54) RAPID DISCONNECT DEVICE

(75) Inventors: Arnd Ehrhardt, Neumarkt/Opf. (DE); Stefanie Schreiter, Neumarkt/Opf. (DE)

(73) Assignee: DEHN + SÖHNE GmbH + Co. KG, Neumarkt/Opf. (DE)

( * ) Notice: Subject to any disclaimer, the term of this patent is extended or adjusted under 35 U.S.C. 154(b) by 1235 days.

(21) Appl. No.: 12/737,835

(22) PCT Filed: Aug. 17, 2009

(86) PCT No.: PCT/EP2009/060616

§ 371 (c)(1),
(2), (4) Date: May 6, 2011

(87) PCT Pub. No.: WO2010/020612

PCT Pub. Date: Feb. 25, 2010

(65) Prior Publication Data

US 2011/0205011 A1 Aug. 25, 2011

(30) Foreign Application Priority Data

Aug. 22, 2008 (DE) ..... 10 2008 039 325
Jan. 12, 2009 (DE) ..... 10 2009 004 317

(51) Int. Cl.
*H01H 37/76* (2006.01)
*H01H 77/04* (2006.01)
(Continued)

(52) U.S. Cl.
CPC *H01T 1/14* (2013.01); *H01C 7/126* (2013.01); *H01H 37/76* (2013.01); *H01H 37/761* (2013.01); *H01H 37/764* (2013.01)

(58) Field of Classification Search
CPC ..... H01T 1/14; H01C 7/126; H01H 37/761; H01H 37/76; H01H 37/764
USPC ..... 337/14, 32, 1, 28, 31, 405, 406, 5, 6; 338/21, 22 R, 24; 361/118, 119
See application file for complete search history.

(56) References Cited

U.S. PATENT DOCUMENTS 4,168,514 A 9/1979 Howell ..... 361/56
5,276,422 A * 1/1994 Ikeda et al. ..... 337/28
(Continued)

FOREIGN PATENT DOCUMENTS

DE 2853697 6/1979 ..... H01H 83/10
DE 3632224 4/1988 ..... H02H 9/04
(Continued)

OTHER PUBLICATIONS

International Preliminary Report on Patentability (Chapter I of the Patent Cooperation Treaty), in English, dated Mar. 1, 2011.
(Continued)

*Primary Examiner* — Anatoly Vortman
(74) *Attorney, Agent, or Firm* — Gerald T. Bodner

(57) ABSTRACT

The invention relates to a rapid disconnect device for surge arrestors, in particular plate-type or flat varistors, comprising at least one element that is maintained under a mechanical stress, and a disconnection point for disconnecting the surge arrestor from the respective power grid upon thermal overload, wherein the disconnection point comprises contacts, the positions of which vary relative to one another, wherein one of said contacts is designed to be fixed. According to the invention, the contacts of varying positions relative to one another are electrically connected without the use of solder in such a way that incident current forces act primarily in the contact force direction and such that the moving contacts of the positionally-variable contacts of a lost element located at the surge arrestor and thermally detachable therefrom can be moved from a closed position to the disconnected position.

19 Claims, 3 Drawing Sheets

(51) Int. Cl.
*H01T 1/14* (2006.01)
*H01C 7/12* (2006.01)

(56) References Cited

U.S. PATENT DOCUMENTS

| | | | | |
|---|---|---|---|---|
| 5,311,164 | A * | 5/1994 | Ikeda et al. | 337/28 |
| 5,867,083 | A * | 2/1999 | Takeuchi et al. | 337/1 |
| 5,933,310 | A * | 8/1999 | Eggendorfer | 361/104 |
| 6,430,019 | B1 * | 8/2002 | Martenson et al. | 361/124 |
| 6,636,403 | B2 * | 10/2003 | McLoughlin et al. | 361/103 |
| 7,483,252 | B2 * | 1/2009 | de Palma et al. | 361/127 |
| 7,738,231 | B2 * | 6/2010 | Lagnoux | 361/115 |
| 7,741,946 | B2 * | 6/2010 | Ho | 337/5 |
| 8,217,750 | B2 * | 7/2012 | Machida | 337/32 |
| 2006/0145807 | A1 | 7/2006 | Gautier | 337/36 |
| 2006/0245125 | A1 * | 11/2006 | Aszmus | 361/56 |
| 2007/0200657 | A1 * | 8/2007 | Tsai et al. | 338/21 |
| 2008/0129440 | A1 * | 6/2008 | Ho | 337/5 |
| 2010/0290168 | A1 * | 11/2010 | Wang | 361/104 |

FOREIGN PATENT DOCUMENTS

| | | | |
|---|---|---|---|
| DE | 3805889 | 5/1989 | H01T 4/08 |
| DE | 4241311 | 6/1994 | H01H 37/76 |
| DE | 102007042989 | 12/2008 | H01C 7/12 |
| EP | 0862255 | 9/1998 | H02H 9/04 |
| WO | WO 2004/064213 | 7/2004 | H01T 1/14 |

OTHER PUBLICATIONS

International Search Report (in English) dated Nov. 5, 2009, International Preliminary Report on Patentability (Chapter I of the Patent Cooperation Treaty), in German, dated Nov. 5, 2009 and English translation of the International Preliminary Report on Patentability (Chapter I of the Patent Cooperation Treaty) dated Mar. 1, 2011.

* cited by examiner

RAPID DISCONNECT DEVICE

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The invention relates to a fast disconnection device for surge arresters, specifically disc-shaped or flat varistors, comprising at least one element held under a mechanical preload as well as a point of separation in order to disconnect the surge arrester from the respective mains in the event of a thermal overload, wherein the point of separation includes contacts, the positions of which are variable relative to each other, and wherein one of these contacts is a fixed one.

(2) Description of Related Art

Disconnection devices of common efficient surge arresters with $I_n$>15 kA 8/20 μs including varistors for use in low-voltage mains generally comprise a soldered connection serving as thermal point of separation, a movable contact being under a mechanical preload, as well as a constricted region which adiabatically melts when reaching its melting integral. The soldered connection of the movable contact part constitutes the connection to the varistor contact and assumes the function of the thermal point of separation disconnecting the varistor from the mains when the varistor is overheated. Typical disconnection devices of this type are shown, for example, in DE 42 41 311 A1 or DE 38 05 889 A1.

In prior assemblies of this type the soldered connection connects two metal parts having a more or less high thermal conduction and quite a high thermal capacity, which is due to the fact that these metal parts have to control all electrical loads occurring in the operative range of the arrester. The soldered connection itself has to meet the requirements of the pulsed current carrying capacity. In addition, the soldered connection is permanently exposed to the mechanical load of the spring preload acting on the movable part of a corresponding lead.

An optimization of the essential functions of the point of separation, namely the desired disconnection from the varistor when it is heated, is thus not possible. Therefore, the solutions according to the prior art are forced to find compromises. As a result thereof, all solutions according to the prior art have in common that the thermal disconnection device has a considerable inertia, which is above all based on the thermal conductivity of the used materials, the necessary cross-sections of the contacts and the resulting great thermal capacity of the overall assemblies.

In the event of an overload, that is, when the varistor is heated as a result of long-lasting overvoltages caused by operation frequencies or as a result of aged varistors, the soldered connection of the disconnection device is heated only gradually due to the above-explained conditions. This means that even upon reaching a temperature critical for the varistor a certain time passes until the soldered connection has reached the necessary melting temperature. This time may be reduced by using solders with melting temperatures below the critical temperatures of the varistor. This is the reason why the varistor is frequently overloaded before a thermal disconnection takes place. However, an overloaded varistor can lead to undefined influences with respect to the resulting fault currents and, thus, to a plurality of different faults and further damages.

An arrester disconnection switch is known from EP 0 862 255 A1, according to which a mechanical switch disconnecting the varistor from the mains can be triggered by means of a fault current measurement and an evaluation. The disadvantageous properties involved by the usual contacting of varistors via a thermal, sensitive, but inevitably delayed-action soldering point can principally be avoided. The effort required for the detection of the fault current and the actuation of the switch as well as for the necessary evaluation is considerable, however.

Document DE 28 53 697 A1 describes a series connection comprised of a varistor and a switch. The thermal overcurrent release of the switch is not only heated by the fault current, but also directly by the heated varistor. Such an assembly, too, is constructively complicated and has the drawback that the release characteristic of the switch can be adapted to the requirements of the varistor to a limited extent only. The release system and the switch as a whole have to thermally and dynamically control pulsed currents in the range of several 10 kA. However, in order to obtain an optimum protection, the release should already be possible at a few mA. A direct heating of the bimetallic release of the switch by the varistor is helpful but, due to the aforementioned requirements, the release has a correspondingly great mass and thermal capacity counteracting a short response time.

Document WO 2004/064213 A1 shows an assembly in which a bimetal locks a switching contact. The bimetal is not flown through by the current. If the bimetal is indirectly heated as a result of the varistor being heated, the movement of the bimetal releases the locking and the varistor is disconnected from the mains. The indirect heating via the electrical connecting leads of the varistor, the geometrical arrangement, the material properties and the inevitably required dimensions of the bimetal likewise preclude, under the physical-constructive aspect, a very short response time until the contact is opened.

DE 36 32 224 A1 discloses a series connection of a switching contact and a varistor, wherein the expansion of an expanding substance is used to disconnect the varistor. The expanding substance is located directly on the varistor and, being applied to the full surface, is heated by the varistor. The expansion of the expanding substance in one direction corresponds the distance traveled by the switching contacts. The prolongation of the isolating distance is therefore not only limited, but is also very slow, so that the switching capacity of the isolating distance as a whole remains reduced. Also, the expansion of the expanding substance takes place with a delay so that a fast disconnection required in the event of a fault cannot be realized.

It becomes obvious that all solutions known from the prior art are only compromises between the possible, obtainable thermal sensitivity of the point of separation and the required current carrying capacity. As a rule, the thermal disconnection devices have a considerable inertia which is due to the good thermal conductivity of the used materials and the necessary large cross-sections for contacts along with a great thermal capacity resulting therefrom.

OBJECTS AND SUMMARY OF THE INVENTION

Therefore, it is the object of the invention to provide a fast disconnection device for surge arresters, specifically disc-shaped or flat varistors, wherein the disconnection device is to become active already before a critical temperature is reached and before the varistor is overloaded and which can moreover be realized with simple means. A fast disconnection has the advantage that currents to be switched by the disconnection device can additionally be limited by the varistor and can thus be disabled without problems. Possible fault conditions occurring when the varistors or the disconnection device, respectively, are overloaded are avoided from the very beginning.

The solution to the object of the invention is achieved with a fast disconnection device as will be described in greater detail.

The central idea of the invention accordingly resides in spatially separating the function-carrying parts for the thermal release function of the disconnection device from the current-carrying connection parts physically and functionally. This permits an optimization of the thermal release function so that considerably shorter release times can be achieved. In a plurality of fault events the respective surge arrester can therefore be reliably separated from the mains before it is destroyed or overloaded.

Accordingly, a fast disconnection device for surge arresters is provided, specifically disc-shaped or flat varistors, comprising at least one element held under a preload, specifically a mechanical preload, wherein further a point of separation is provided in order to disconnect the surge arrester from the respective mains in the event of a thermal overload, wherein the point of separation includes contacts, the positions of which are variable relative to each other, and wherein one of these contacts is a fixed one.

According to the invention the contacts, the positions of which are variable relative to each other, are electrically connected without the use of a solder in such a way that occurring current forces act mainly in the direction of the contact force, however, are at least not oriented opposite to this contact force. The movable one of the position-variable contacts is transferable from a closed position into a disconnected position by a lost element located thermally separable on the surge arrester.

According to one embodiment of the invention the lost element is acted on by a force exerted by the element held under a mechanical preload.

The lost element may be realized as a thermally activatable bolt, block or pin which secures the contacts held in a solderless manner.

At one point, the bolt, the block or the pin is connected to the surge arrester by a thermally separable means, at which point an early maximum heating can be expected in the event of an overload.

The lost element and/or its fixing means only have a low thermal capacity and a low thermal conductivity. Due to the low thermal capacity and low thermal conductivity of the lost element and the fixing means thereof the solder, being a temperature-sensitive fixing material, is not unnecessarily cooled. The heat generated in the varistor is therefore almost exclusively and directly utilized for heating the very small solder mass, so that very fast response times can be ensured.

According to another embodiment the lost element is directly held under a spring force preload and is secured to the surge arrester by a thermally sensitive means.

In the event of an overload the lost element indirectly or directly actuates the movable contact by using the spring force preload so as to cause the disconnected state.

In this embodiment the position of the movable contact from a disconnected position back to a closed position can be varied, i.e. it is reversible.

In another embodiment a thermally sensitive region or section may be provided inside the bolt, block or pin so as to obtain a mechanical separation of a part of the bolt, block or pin.

A force-intensifying system, specifically a lever mechanism, may be provided between the lost element and the movable one of the contacts.

According to another embodiment an electrical connection to additional extinguishing means, e.g. arc baffles, is provided in the target region of the disconnected position of the movable contact element.

The invention shall be explained in more detail below by means of an embodiment and with the aid of figures.

DETAILED DESCRIPTION OF THE PREFERRED EMBODIMENTS

Figure 1:
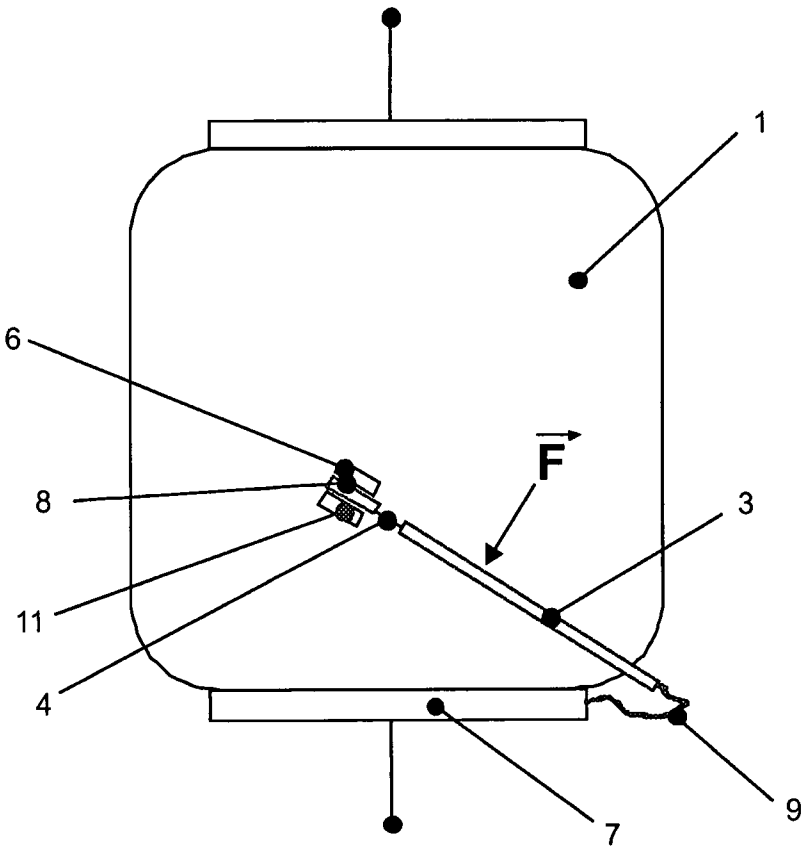
FIG. 1 shows a schematic representation of a first embodiment of the invention, including a lost element fixed to the varistor by a thermally sensitive means.

It is known that portions of varistors are heated differently, which is due to the installation situation, the material composition, the geometry and their contacting of the contact plates as well as the current distribution.

This means, in accordance with the aforementioned conditions, the point and/or region heated strongest is to be chosen for positioning the thermally separable means.

The thermally separable means and the part fixed by it, respectively, if in direct contact with the varistor, should be realized such that the thermal capacity is as low as possible and also the heat dissipation is reduced.

By avoiding that the chosen positioning point is influenced by the heating caused by an undesired heat dissipation it is ensured the intended, fastest possible temperature-sensitive disconnection of the varistor and, thus, an optimum adaptation for the protection thereof. Preferably, the response temperature of the thermally separable means is slightly above the temperature maximally reached at the varistor under normal operating conditions.

In order to realize a release of the disconnection device with as little delay as possible the movable contact piece is acted on by an adequate spring preload. According to the invention, the connection of the movable contact piece to the varistor is accomplished with a loose, solderless contact point or clamping point.

The demands described below are made on this contact point. In the event of surge current loads in the nominal range no aging or burn-off is to occur at this connection. The connection is not to have any noteworthy reaction on the residual voltage and, thus, on the protection level. Furthermore, the connection is to be realized such that it does not get welded together when exposed to surge current loads, so that the stability of the connection is clearly below the force available for the movement resulting from the spring preload.

When realizing such a contact point it is an advantage if the direction of the current forces occurring during the surge current load does not act against the contact force.

All embodiments have in common that a thermally sensitive part or material is provided on the surface of the varistor heated strongest. This part should be as small as possible and have a lowest possible thermal capacity. The hottest point of the varistor can be influenced with respect to its position by the design of the varistor body and the choice of the material, as well as by the geometry of the contact plate. By this it is possible to shape the varistor body with respect to thickness and influence it by a different composition of the base material of the varistor so that, for example, regions having different conductivities are provided by a suitable doping. The thermally sensitive part accordingly serves to fix the lost element and has a negligible volume and, thus, only a small mass in relation to the varistor, that is, in the range of <10 mg. Thus, the thermally sensitive part adopts the same temperature as the varistor quasi without a time delay. As explained before, the lost element only has a very low thermal capacity and low thermal conductivity, so that no noteworthy temperature gradient develops between the solder and the varistor.

By the above-explained choice of materials (different thermal conductivity in the axial and radial direction and geometry—creation of heat traps) the heat flow density of the contact surfaces and thus the position of the region with the strongest heating can be influenced systematically. Waxes, adhesives, solders or other materials having a melting point or softening temperature slightly above the usual operating temperature of the varistor are suited for the fixing.

If necessary, an additional defined spring force, preferably vertical to the spring force acting on the movable contact, can be used at the fixed contact of the varistor to ensure that the force necessary for the contact connection is permanently available.

If further connections and additional parts are provided, they likewise only have a low thermal capacity and low thermal conduction. Preferably, these parts are made of insulating materials, or an intermediate layer of an insulating material is provided for the thermal decoupling. If a partial use of materials having different properties is necessary an intermediate layer is used to suppress an undesired heat conduction.

If it is necessary for constructive reasons to provide the temperature-sensitive region not directly at the varistor, this region may also be provided or placed, for example, inside the part blocking the disconnection, i.e. the bolt, block or pin. In this case the thermal conduction is optimized up to this functional region, while the thermal capacity is reduced to a minimum.

When the melting temperature of the temperature-sensitive region or section is reached the part blocking the disconnection is quasi pushed aside or pressed away by the spring force, whereby it is provided that the lost part, now being loose, does not impede the disconnection. This may be assisted by suited guides (not shown in the figures).

If, for example, the required space conditions do not permit the realization of corresponding guides, the blocking part may also be configured, for example, as an eccentric element so that, when the melting temperature of the temperature-sensitive region is reached, this part is moved, for example by the applied spring force, about a defined fulcrum, thereby releasing the movable contact.

By guiding the blocking part about a defined fulcrum the movement of the movable contact is not impeded. Grooves and similar measures can support the desired rotational movement. If such eccentric parts are combined, means for increasing the insulating strength and for increasing the switching capacity of the disconnection device may be used at the same time, e.g. in the form of insulating foils or insulating tubes. Such insulating parts may be provided separately, but may also be fixed directly to the movable switching contact.

As an alternative to the direct fixing of the contact tongue preloaded by a spring it is also possible that only one unlocking mechanism of a switching contact, optionally also an external one, is blocked. In such an embodiment the holding forces can be reduced.

A first embodiment of the invention according to FIG. 1 is based on a varistor disc 1 having external connections 7.

A first varistor contact 6 represents one of the contacts that form the point of separation and the positions of which are variable relative to each other.

The movable part 8 of the position-variable contacts lies against the varistor contact 6. The contacts 6 and 8 are secured by a lost element 11. This lost element 11 is connected to the varistor surface by a thermally separable means.

Additionally, a constricted region 4 may be provided in the contact bow 3, which is connected by a line 9 to the external connection 7.

A spring force F acts on the contact bow 3, wherein an undesired positional displacement of the contacts 6 and 8 during normal operation is prevented by the lost element 11.

The contacts 6 and 8, which are movable relative to each other, are electrically connected without the use of a solder, and are configured such that occurring current forces act mainly in the direction of the contact force (not shown in FIG. 1).

In the event of a thermal overload the connection of the lost element 11 to the surface of the varistor 1 is disconnected. Thus, the function of the lost element 11 as a stop is canceled and the movable part 8 of the contacts can move in the direction of the released force vector so that the desired state of disconnection is realized.

Figure 2:
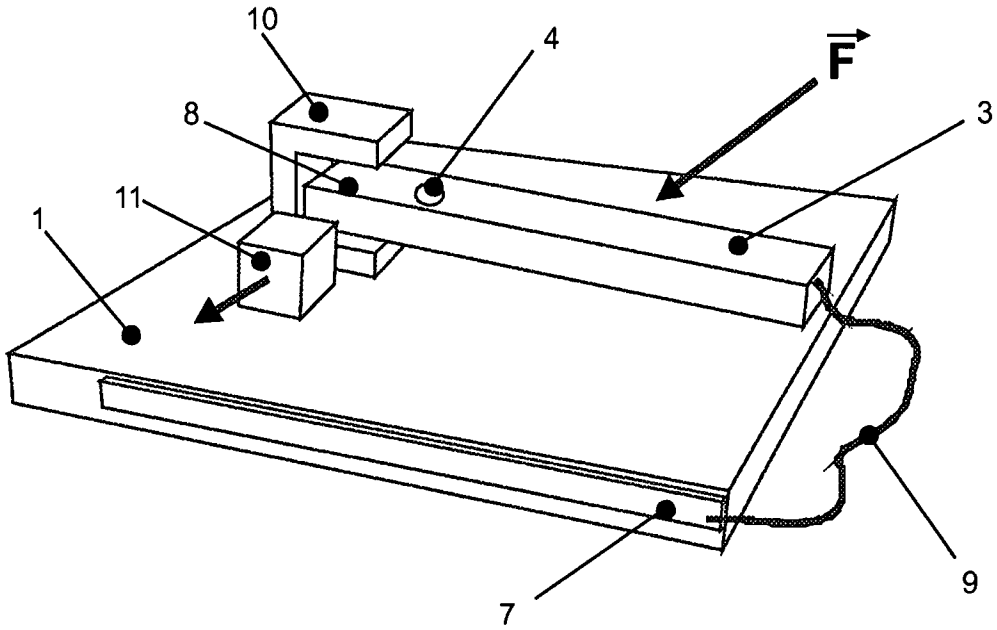
FIG. 2 shows an embodiment similar to that of FIG. 1, including a clamping contact.

A similar, but three-dimensional representation of an embodiment of the invention is shown in FIG. 2. The direction of the movement of the lost element 11 is here symbolized by an arrow. The movable part 8 of the contacts is here contacted without the use of a solder by a symbolically shown clamping pocket 10. However, this mechanical contact with each other is realized in such a manner that, when the lost element 11 is released, the disconnecting movement can take place in the direction of force F without any interference.

In FIG. 3, again, a varistor 1 is shown, which comprises two varistor connections 6 and 7.

Varistor connection 6 is connected to the mains by the disconnection device comprising means 3, 4 and 10.

Figure 3:
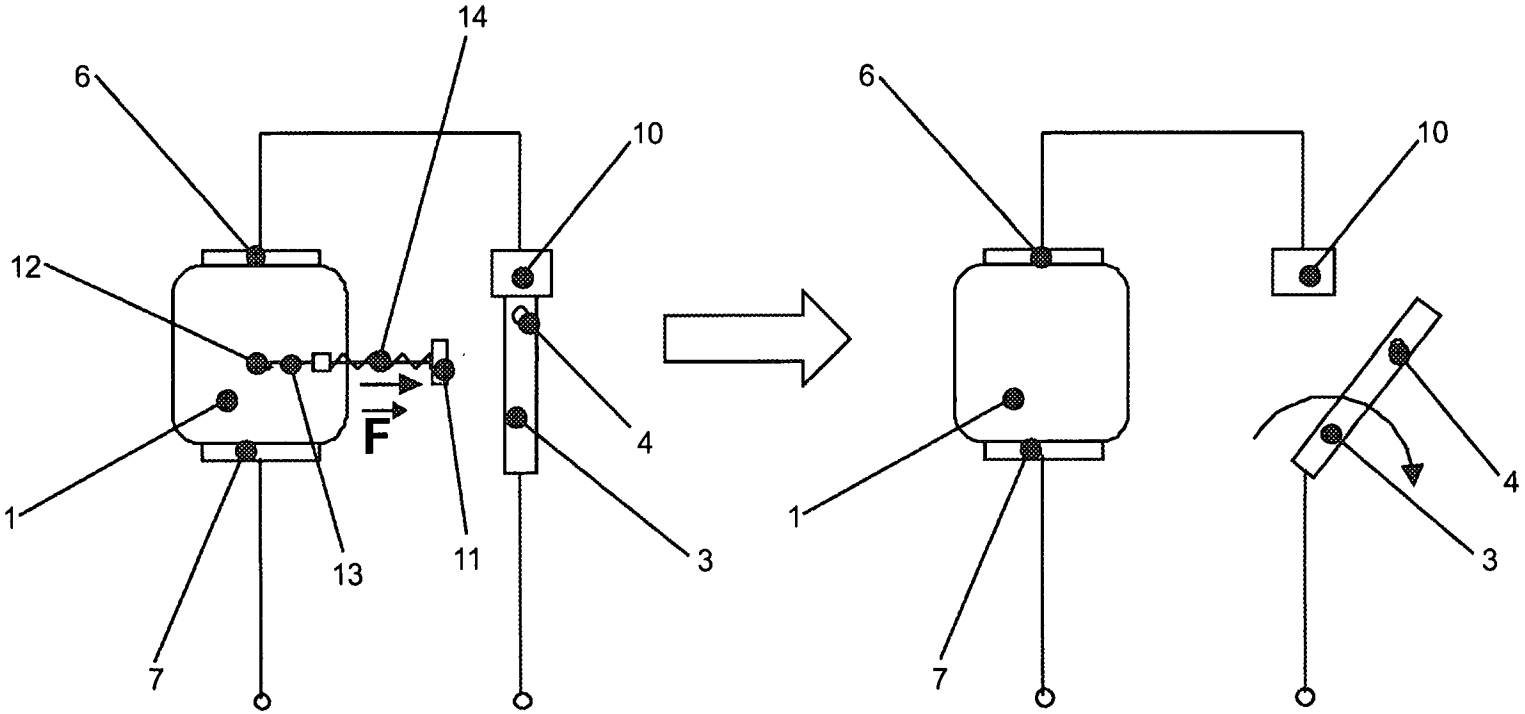
FIG. 3 shows two states of a fast disconnection device (closed and open), wherein the lost element acts on the movable contact piece either similar to a projectile or via a force-transferring system (not shown).

Moreover, in the embodiment according to FIG. 3, a non-conducting thread or wire 13 is provided, which is made of a high-strength material having a low thermal expansion. The thread 13 is fixed to the varistor, directly or indirectly, by means of temperature-sensitive material 12. On the left-hand side of FIG. 3 this material directly blocks the force of spring 14 or a part thereof, wherein the spring 14 acts on the lost element 11 with a preload force F.

In the event of a disconnection (right-hand side of FIG. 3) the blocking thread or wire 13 is released and spring 14 relaxes. By this, a force is released abruptly, which acts on the lost element 11, which actuates the contact bow 13 so that the latter is disconnected from element 10, thus accomplishing the disconnected state. The contact bow 3 may be configured to be pivotable about an axis, which is symbolized by the circular arrow.

Force-intensifying means, e.g. lever mechanisms or the like, may be provided between the lost element 11 and the contact bow 3.

Owing to their significantly shorter response time the introduced embodiments can reliably protect varistors against destruction even at high mains frequency overvoltages.

By realizing the contact point quasi as a loose, solderless connection also extinguishing means may be used in an easy manner for increasing the circuit-breaking capacity of the disconnection device. These can be, for example, deion chambers, fission chambers or insulating web chambers and the like. To this end, corresponding contacts for arc baffles are merely disposed at the fixed varistor contact and the target region of the movable contact.

Also, it is possible to direct hot gas, which may develop in the event of a fault, directly to the temperature-sensitive region. In such an embodiment the wire or thread may also be realized as conducting ones. The wire here serves as an electrode destructible by the thermal action of the arc so that, in this case too, the disconnection device is reliably opened.

LIST OF REFERENCE NUMBERS

1 varistor
3 contact bow
4 constricted region
6 varistor contact
7 external connection
8 movable part of the contacts
9 line
10 clamping pocket
11 lost element
12 temperature-sensitive means
13 thread or wire
14 spring

What is claimed is:

1. A fast disconnection device for a surge arrester comprising:

at least one first element held under a mechanical preload as well as a point of separation in order to disconnect the surge arrester from a source of power in the event of a thermal overload;

a fixed electrical contact and a movable electrical contact, the fixed electrical contact and the movable electrical contact being situated at the point of separation, the positions of the electrical contacts being variable relative to each other, the electrical contacts being electrically connected without the use of a solder in such a way that occurring current forces act mainly in the direction of the contact force;

a lost element, the lost element being selectively fixed to the surge arrester and being mechanically separable therefrom; and thermally-sensitive fixing means selectively fixing the lost element to the surge arrester;

wherein the movable electrical contact is selectively held in place by the lost element in a closed position in which current may flow through the surge arrester, and is movable from the closed position to a disconnected position in which current cannot flow through the surge arrester when the lost element is mechanically separated from the surge arrester, the lost element not carrying the current passing through the surge arrester; and wherein heat generated by the surge arrester heats the thermally-sensitive fixing means which allows the lost element to separate mechanically from the surge arrester, the lost element, mechanically separated from the surge arrester, allowing the movable electrical contact to move from the closed position to the disconnected position.

2. The disconnection device according to claim 1, characterized in that the lost element is acted on by a force exerted by the at least one first element held under a mechanical preload.

3. The disconnection device according to claim 1, characterized in that the lost element is realized as a thermally activatable bolt, block or pin which secures the movable electrical contact held in a solderless manner.

4. The disconnection device according to claim 3, characterized in that the bolt, the block or the pin is connected to the surge arrester by the thermally-sensitive fixing means.

5. The disconnection device according to claim 1, characterized in that the lost element is directly held under a spring force preload and is secured to the surge arrester by the thermally-sensitive fixing means, wherein, in the event of an overload, the lost element allows the movable electrical contact to move to the disconnected position by using the spring force preload.

6. The disconnection device according to claim 5, characterized in that the position of the movable electrical contact can be varied from the disconnected position back to the closed position.

7. The disconnection device according to claim 4, characterized in that the bolt, block or pin includes a thermally-sensitive region or section provided therewithin so as to obtain a mechanical separation of a portion of the bolt, block or pin.

8. The disconnection device according to claim 5, characterized in that a force-intensifying system in the form of a lever mechanism is provided between the lost element and the movable electrical contact.

9. The disconnection device according to claim 1, which further comprises:

means for extinguishing an arc, the arc extinguishing means being provided near the disconnected position of the movable electrical contact.

10. The disconnection device according to claim 2, characterized in that the lost element is realized as a thermally activatable bolt, block or pin which secures the movable electrical contact held in a solderless manner.

11. The disconnection device according to claim 2, which further comprises:

means for extinguishing an arc, the arc extinguishing means being provided near the disconnected position of the movable electrical contact.

12. The disconnection device according to claim 3, which further comprises:

means for extinguishing an arc, the arc extinguishing means being provided near the disconnected position of the movable electrical contact.

13. The disconnection device according to claim 4, which further comprises:

means for extinguishing an arc, the arc extinguishing means being provided near the disconnected position of the movable electrical contact.

14. The disconnection device according to claim 5, which further comprises:

means for extinguishing an arc, the arc extinguishing means being provided near the disconnected position of the movable electrical contact.

15. The disconnection device according to claim 9, wherein the arc extinguishing means includes arc baffles.

16. The disconnection device according to claim 11, wherein the arc extinguishing means includes arc baffles.

17. The disconnection device according to claim 12, wherein the arc extinguishing means includes arc baffles.

18. The disconnection device according to claim 13, wherein the arc extinguishing means includes arc baffles.

19. The disconnection device according to claim 14, wherein the arc extinguishing means includes arc baffles.

* * * * *